US009048602B2

(12) United States Patent
Seitz et al.

(10) Patent No.: US 9,048,602 B2
(45) Date of Patent: Jun. 2, 2015

(54) AUDIO-VISUAL CONNECTOR

(75) Inventors: Kari Ensio Seitz, Tampere (FI); Jari R. Kytöläinen, Nokia (FI); Petri Ihalainen, Tampere (FI); Pasi Hyttinen, Tampere (FI); Jarmo Ketko, Tampere (FI); Michaela Reuscher, Ulm (DE); Andreas Fromel, Ulm (DE); Ralf Beck, Günzburg (DE)

(73) Assignee: Nokia Technologies Oy, Espoo (FI)

( * ) Notice: Subject to any disclaimer, the term of this patent is extended or adjusted under 35 U.S.C. 154(b) by 91 days.

(21) Appl. No.: 13/561,643

(22) Filed: Jul. 30, 2012

(65) Prior Publication Data

US 2014/0030931 A1 Jan. 30, 2014

(51) Int. Cl.

| | |
|---|---|
| ***H01R 24/04*** | (2006.01) |
| ***H01R 24/76*** | (2011.01) |
| ***H01R 13/187*** | (2006.01) |
| ***H01R 13/52*** | (2006.01) |
| ***H01R 13/24*** | (2006.01) |
| ***H01R 24/58*** | (2011.01) |

(52) U.S. Cl.

CPC ..... *H01R 24/76* (2013.01); *H01R 13/187* (2013.01); *H01R 13/52* (2013.01); *H01R 13/5213* (2013.01); *H01R 13/2435* (2013.01); *H01R 24/58* (2013.01)

(58) Field of Classification Search

USPC ..... 439/682, 521, 591, 637, 668, 669, 892, 439/893, 926

See application file for complete search history.

(56) References Cited

U.S. PATENT DOCUMENTS

| | | | | |
|---|---|---|---|---|
| 4,367,907 | A * | 1/1983 | Buck | 439/188 |
| 5,457,607 | A | 10/1995 | Carvalho | |
| 6,347,796 | B1 | 2/2002 | Grossman | |
| 7,297,024 | B2 * | 11/2007 | Ni et al. | 439/607.23 |
| 7,568,954 | B2 * | 8/2009 | Li et al. | 439/668 |
| 7,871,299 | B2 * | 1/2011 | Kawasaki et al. | 439/669 |
| 8,002,564 | B2 * | 8/2011 | Cao | 439/205 |
| 2011/0068665 | A1 | 3/2011 | Cao | |

FOREIGN PATENT DOCUMENTS

| | | | |
|---|---|---|---|
| DE | 202010009467 | U1 | 10/2010 |
| EP | 1569504 | A1 | 8/2005 |

* cited by examiner

*Primary Examiner* — Neil Abrams
*Assistant Examiner* — Travis Chambers
(74) *Attorney, Agent, or Firm* — Alston & Bird LLP

(57) ABSTRACT

A cover for an electronic device is provided that may include a connector housing integrally molded with the cover. The connector housing may define a cavity configured to receive a connector plug therein, and a plurality of connector springs may be configured to contact the connector plug when the connector plug occupies the cavity. The plurality of springs may be protected and, as such, may not be visible when the cover is removed from the electronic device.

22 Claims, 6 Drawing Sheets

AUDIO-VISUAL CONNECTOR

TECHNOLOGICAL FIELD

An example embodiment of the present invention relates generally to a cover for an electronic device, and more particularly, relates to a cover with an audio-visual connector integrated to the cover.

BACKGROUND

Mobile terminals and other electronic devices now include capabilities to provide users with devices to capture media content and/or provide media content to users. For example, user interaction with mobile terminals provides users with the ability to record media whenever users have access to an appropriately configured mobile terminal. In addition, mobile terminals and other electronic devices are capable of providing users with media content for the user to review. Media content, such as audio recordings, may be provided to the user via speakers. Other mobile terminals and electronic devices may include a connector jack and/or connector housing configured to receive a headphone plug therein so as to provide media content to the user via headphones. Further still, users may be able to record audio media content using a microphone, which may also be connected to the mobile terminal via a connector jack and/or connector housing.

In order to provide increased usability of mobile terminals and other electronic devices, manufacturers are continuously developing improvements to mobile terminals, such as providing mobile terminals with audio-visual connectors capable of connecting a mobile terminal to a larger display, such as a television and/or monitor. Additionally, mobile terminals now include various shapes and designs such that attaching a connector housing configured to receive a headphone jack, microphone jack; and/or other audio-visual connector jack to a mobile terminal cover in a water-resistant and/or waterproof manner has become increasing difficult. Further, when such a cover with an attached connector housing is removed from the electronic device, the exposure of connector housing parts may be more susceptible to damage and/or mishandling.

BRIEF SUMMARY

Various embodiments of the present invention are directed to a cover for an electronic device. In one embodiment, the cover for an electronic device may comprise a connector housing integrally molded with the cover, the connector housing defining a cavity configured to receive a connector plug therein. The cover may further comprise a plurality of connector springs configured to contact the connector plug when the connector plug occupies the cavity. The plurality of connector springs may be protected when the cover is removed from the electronic device.

According to one embodiment, the connector housing may include a plurality of slots configured to receive the plurality of connector springs therein. The cover may also include a cavity defined by the connector housing that is substantially cylindrical. In some embodiments, the cover may comprise a plastic material.

According to some embodiments, the cover may further comprise a connector plug aperture defined by a perimeter surface of the cover. In addition, the connector plug aperture may be substantially aligned with the cavity. In some embodiments, the connector plug aperture may be substantially circular in shape. In another embodiment, the connector plug aperture may be substantially oval in shape. According to some embodiments, the plurality of springs may not be exposed when the cover is removed from the electronic device. Additionally and/or alternatively, the connector springs may not protrude from the connector housing when the connector housing is removed from the electronic device.

According to some embodiments of the present invention, a cover for an electronic device may comprise a connector housing integrated with the cover, wherein the connector housing defines a cavity configured to receive a connector plug therein. The cover may include a plurality of connector springs configured to contact the connector plug when the connector plug occupies the cavity. In some embodiments, the plurality of springs may be protected when the cover is removed from the electronic device. Additionally and/or alternatively, the connector housing may be permanently coupled to the cover. In some embodiments, the connector housing may be welded to the cover.

BRIEF DESCRIPTION OF THE SEVERAL VIEWS OF THE DRAWINGS

Figure 1:
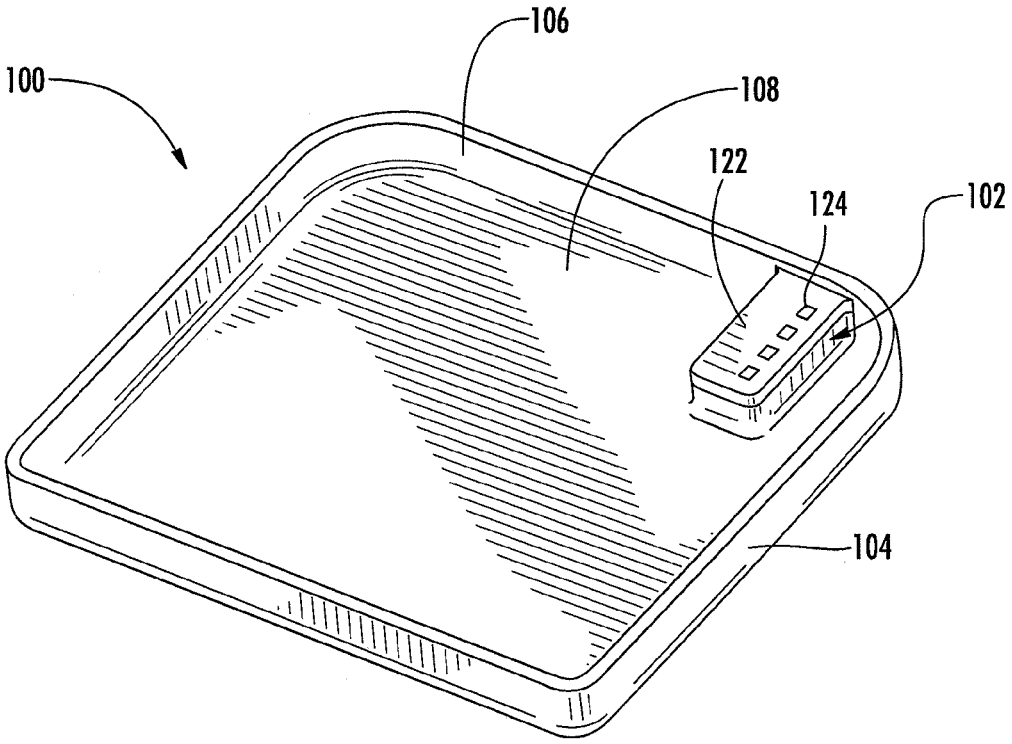
Figure 2:
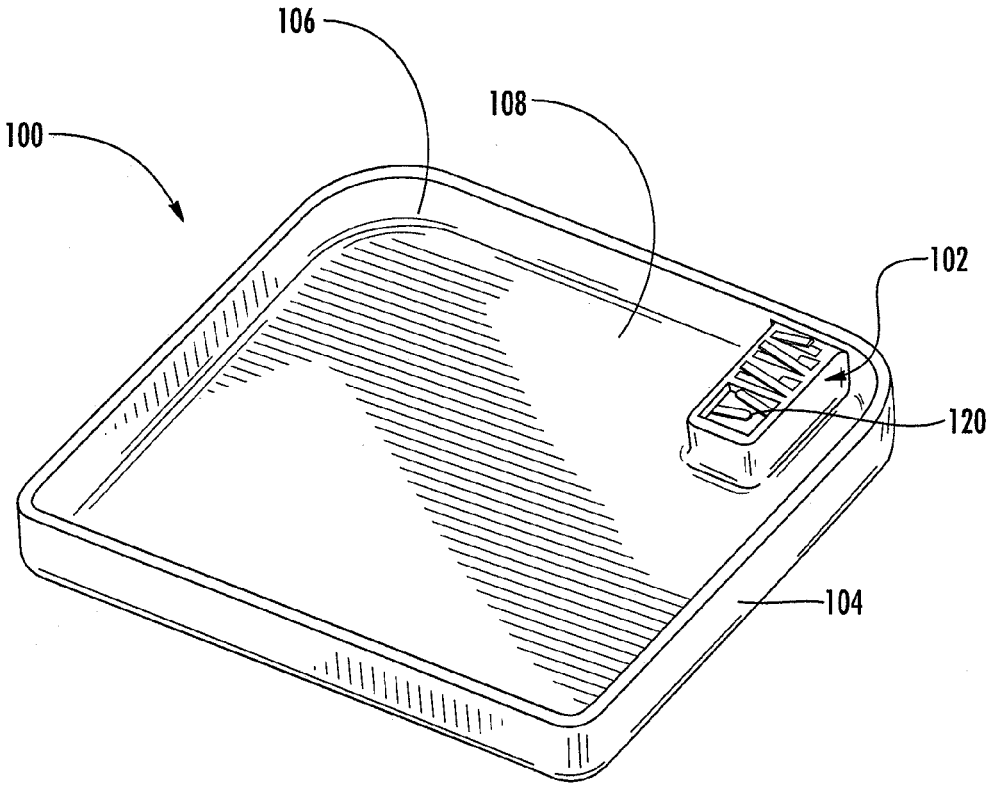
Figure 3:
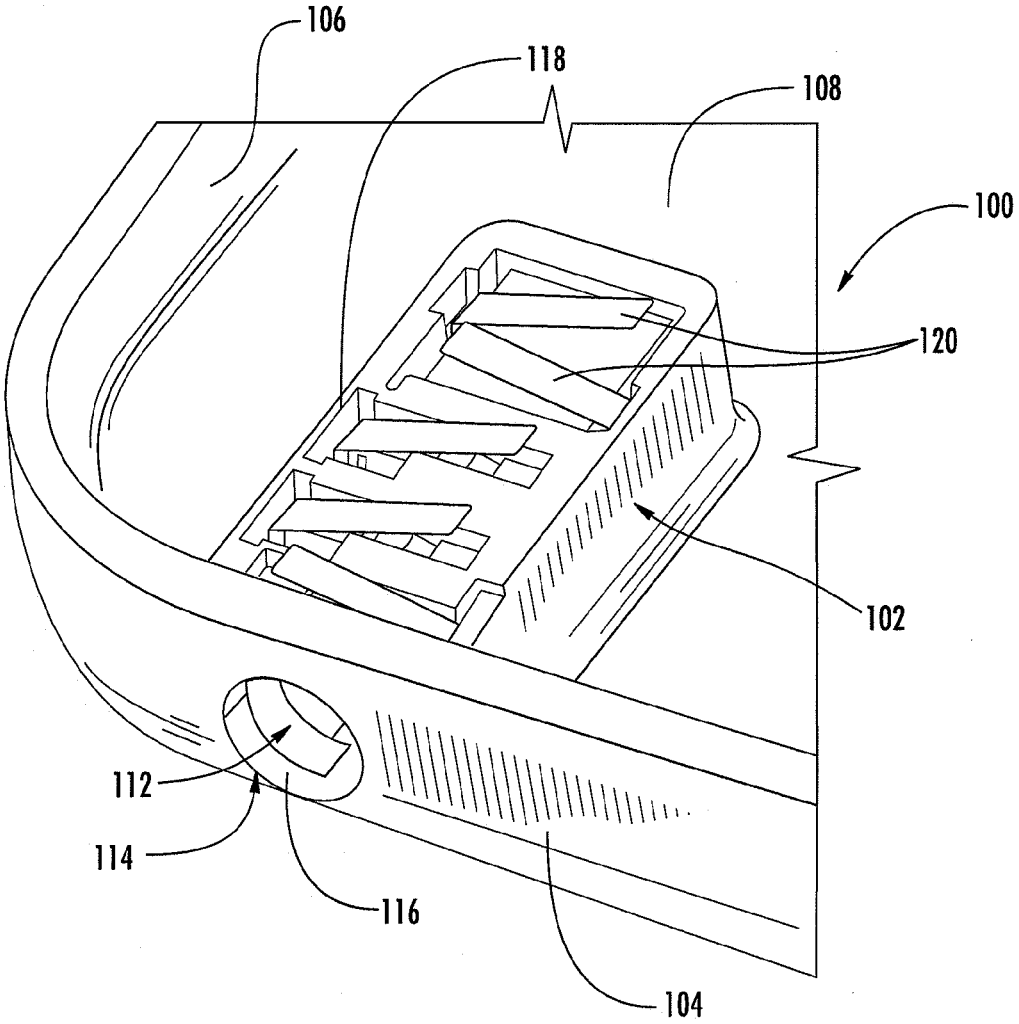
Figure 4:
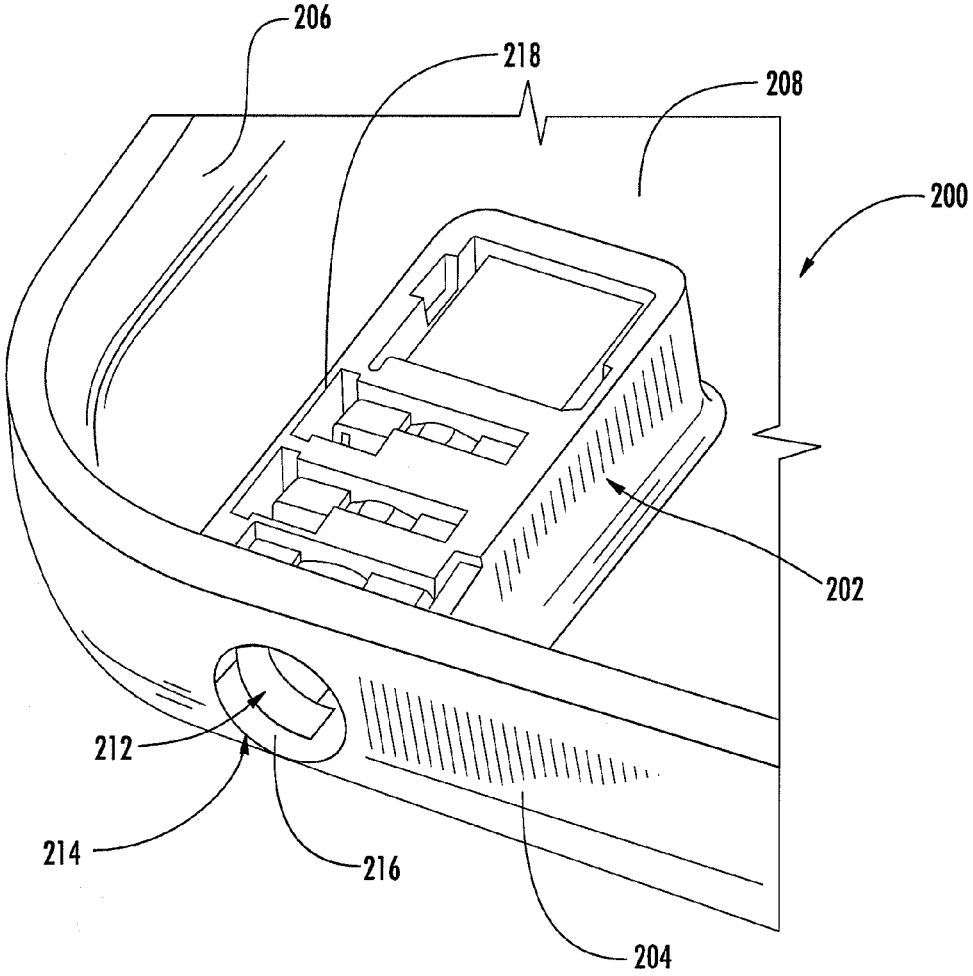
Figure 5:
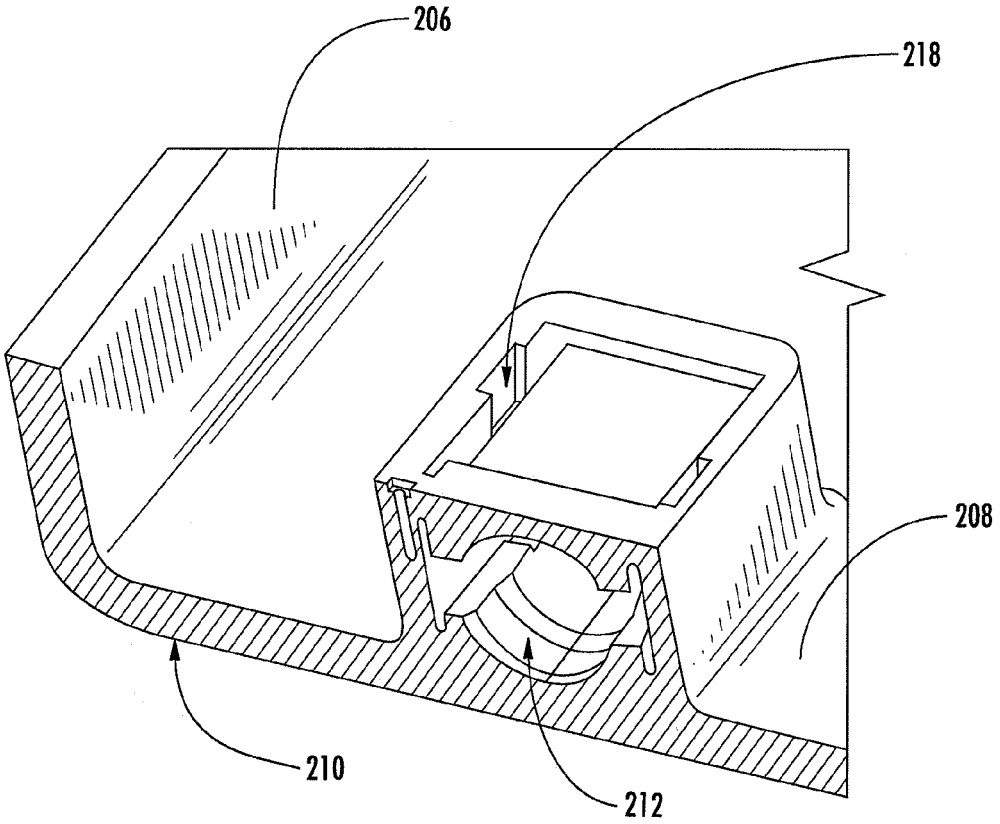
Figure 6A:
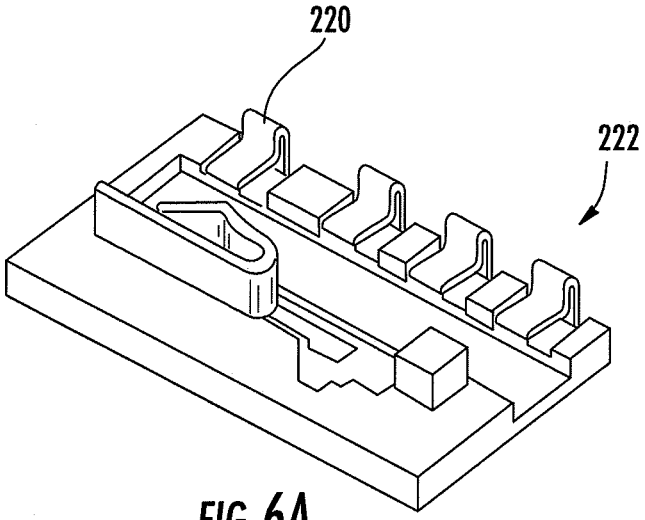
Figure 6B:
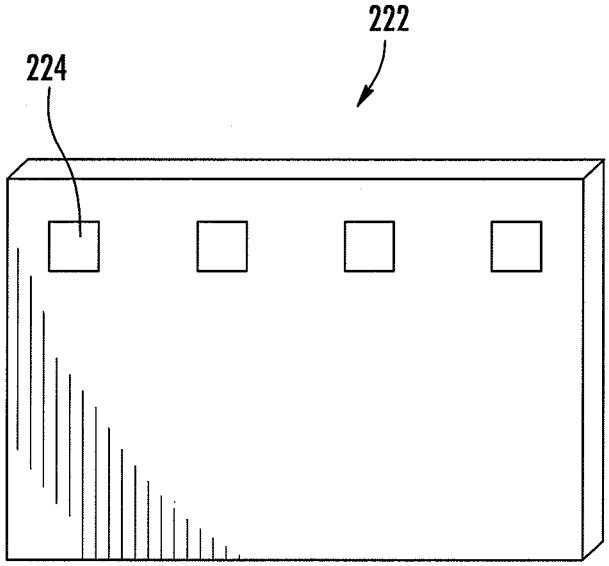

Having thus described example embodiments of the present disclosure in general terms, reference will now be made to the accompanying drawings, which are not necessarily drawn to scale, and wherein:

FIG. 1 illustrates an electronic device cover according to an example embodiment of the present invention;

FIG. 2 illustrates an electronic device cover according to an example embodiment of the present invention;

FIG. 3 illustrates an electronic device cover according to an example embodiment of the present invention;

FIG. 4 illustrates an electronic device cover according to an example embodiment of the present invention;

FIG. 5 illustrates a cross-sectional view of an electronic device cover according to an example embodiment of the present invention;

FIG. 6A illustrates a connector plate according to one example embodiment of the present invention; and FIG. 6B illustrates a connector plate according to one example embodiment of the present invention.

DETAILED DESCRIPTION

Some embodiments of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein. Like reference numerals refer to like elements throughout. The terms top, bottom, side, up, down, upwards, downwards, vertical, horizontal and the like as used herein do not imply a required limitation in all embodiments of the present invention, but rather are used to herein to help describe relative direction or orientation in the example embodiments illustrated in the figures.

Various embodiments of the present invention generally provide for an electronic device cover 100 for an electronic device, such as a mobile terminal. In some embodiments, the mobile terminals may be capable of communicating with other devices, such as other user terminals, either directly, or via a network. The network may include a collection of various different nodes, devices or functions that may be in communication with each other via corresponding wired and/or wireless interfaces. Although not necessary, in some embodiments, the network may be capable of supporting communication in accordance with any one or more of a number of first-generation (1G), second-generation (2G), 2.5G, third-generation (3G), 3.5G, 3.9G, fourth-generation (4G) mobile communication protocols, Long Term Evolution (LTE), and/or the like. Thus, the network may be a cellular network, a mobile network and/or a data network, such as a local area network (LAN), a metropolitan area network (MAN), and/or a wide area network (WAN), for example, the Internet. In turn, other devices such as processing elements (for example, personal computers, server computers or the like) may be included in or coupled to the network. By directly or indirectly connecting the mobile terminals and the other devices to the network, the mobile terminals and/or the other devices may be enabled to communicate with each other, for example, according to numerous communication protocols including Hypertext Transfer Protocol (HTTP) and/or the like, to thereby carry out various communication or other functions of the user terminal and the other devices, respectively. As such, the mobile terminals and the other devices may be enabled to communicate with the network and/or each other by any of numerous different access mechanisms. For example, mobile access mechanisms such as universal mobile telecommunications system (UMTS), wideband code division multiple access (W-CDMA), CDMA2000, time division-synchronous CDMA (TD-CDMA), global system for mobile communications (GSM), general packet radio service (GPRS) and/or the like may be supported as well as wireless access mechanisms such as wireless LAN (WLAN), Worldwide Interoperability for Microwave Access (WiMAX), WiFi, ultra-wide band (UWB), Wibree techniques and/or the like and fixed access mechanisms such as digital subscriber line (DSL), cable modems, Ethernet and/or the like. Thus, for example, the network may be a home network or other network providing local connectivity.

Although numerous types of mobile terminals, such as portable digital assistants (PDAs), mobile telephones, pagers, mobile televisions, gaming devices, laptop computers, cameras, tablet computers, touch surfaces, wearable devices, video recorders, audio/video players, radios, electronic books, positioning devices (e.g., global positioning system (GPS) devices), or any combination of the aforementioned, and other types of voice and text communications systems, may readily employ embodiments of the present invention, other devices including fixed (non-mobile) electronic devices may also employ some example embodiments.

The mobile terminal may include an antenna (or multiple antennas) in communication with a transmitter and a receiver. The mobile terminal may also include a processor configured to provide signals to and receive signals from the transmitter and receiver, respectively. The processor may, for example, be embodied as various means including circuitry, one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits such as, for example, an application specific integrated circuit (ASIC) or field programmable gate array (FPGA), or some combination thereof. In some embodiments, the processor may comprise a plurality of processors. These signals sent and received by the processor may include signaling information in accordance with an air interface standard of an applicable cellular system, and/or any number of different wireline or wireless networking techniques, comprising but not limited to Wi-Fi, wireless local area network (WLAN) techniques such as Institute of Electrical and Electronics Engineers (IEEE) 802.11, 802.16, and/or the like. In addition, these signals may include media content data, user generated data, user requested data, and/or the like. In this regard, the mobile user terminal may be capable of operating with one or more air interface standards, communication protocols, modulation types, access types, and/or the like. Some Narrow-band Advanced Mobile Phone System (NAMPS), as well as Total Access Communication System (TACS), mobile user terminals may also benefit from embodiments of this invention, as should dual or higher mode phones (e.g., digital/analog or time division multiple access (TDMA)/code division multiple access (CDMA)/analog phones). Additionally, the mobile terminal may be capable of operating according to Wi-Fi or Worldwide Interoperability for Microwave Access (WiMAX) protocols.

It is understood that the processor may comprise circuitry for implementing audio/video and logic functions of the mobile terminal. For example, the processor may comprise a digital signal processor device, a microprocessor device, an analog-to-digital converter, a digital-to-analog converter, and/or the like. Control and signal processing functions of the mobile terminal may be allocated between these devices according to their respective capabilities. Further, the processor may comprise functionality to operate one or more software programs, which may be stored in memory. For example, the processor may be capable of operating a connectivity program, such as a web browser. The connectivity program may allow the mobile terminal 10 to transmit and receive web content, such as location-based content, according to a protocol, such as Wireless Application Protocol (WAP), hypertext transfer protocol (HTTP), and/or the like. The mobile terminal may be capable of using a Transmission Control Protocol/Internet Protocol (TCP/IP) to transmit and receive web content across the internet or other networks.

The mobile terminal may also comprise a user interface including, for example, an earphone or speaker, a ringer, a microphone, a display, a user input interface, and/or the like, which may be operationally coupled to the processor. In this regard, the processor may comprise user interface circuitry configured to control at least some functions of one or more elements of the user interface, such as, for example, the speaker, the ringer, the microphone, the display, the media recorder, the keypad and/or the like. In addition, the processor may further comprise user interface circuitry configured to control at least some functions of one or more elements of the user interface, such as a media recorder configured to capture media content. The processor and/or user interface circuitry comprising the processor may be configured to control one or more functions of one or more elements of the user interface through computer program instructions (e.g., software and/or firmware) stored on a memory accessible to the processor (e.g., volatile memory, non-volatile memory, and/or the like). Although not shown, the mobile terminal may comprise a battery for powering various circuits related to the mobile user terminal, for example, a circuit to provide mechanical vibration as a detectable output. The display of the mobile terminal may be of any type appropriate for the electronic device in question with some examples including a plasma display panel (PDP), a liquid crystal display (LCD), a light-emitting diode (LED), an organic light-emitting diode display (OLED), a projector, a holographic display or the like. The display may, for example, comprise a three-dimensional touch display. The user input interface may comprise devices allowing the mobile user terminal to receive data, such as a keypad, a touch display (e.g., some example embodiments wherein the display is configured as a touch display), a joystick (not shown), and/or other input device. In embodiments including a keypad, the keypad may comprise numeric (0-9) and related keys (#, *), and/or other keys for operating the mobile user terminal.

The mobile terminal may comprise memory, such as a user identity module (UIM), a removable user identity module (R-UIM), and/or the like, which may store information elements related to a mobile subscriber. In addition to the UIM, the mobile user terminal may comprise other removable and/or fixed memory. The mobile terminal may include non-transitory volatile memory and/or non-transitory, non-volatile memory. For example, volatile memory may include Random Access Memory (RAM) including dynamic and/or static RAM, on-chip or off-chip cache memory, and/or the like. Non-volatile memory, which may be embedded and/or removable, may include, for example, read-only memory, flash memory, magnetic storage devices (e.g., hard disks, floppy disk drives, magnetic tape, etc.), optical disc drives and/or media, non-volatile random access memory (NVRAM), and/or the like. Like volatile memory, non-volatile memory may include a cache area for temporary storage of data. The memories may store one or more software programs, instructions, pieces of information, data, and/or the like which may be used by the mobile user terminal for performing functions of the mobile terminal. For example, the memories may comprise an identifier, such as an international mobile equipment identification (IMEI) code, capable of uniquely identifying the mobile terminal.

In some embodiments, the cover 100 may be configured to provide at least a portion of a housing for an electronic device, such as a mobile terminal. Accordingly, the cover 100 and the electronic device, when fully-assembled, may define a chamber to house, protect, and/or enclose therein, a printed circuit board, printed wiring board, and/or other electronic components of the electronic device. According to some embodiments, the cover may include a connector housing configured to receive a connector plug therein. For example, the connector housing may include an audio-visual connector jack configured to receive a headphone plug, headset plug, and/or the like therein. One advantageous aspect of embodiments of the present invention includes providing a cover for an electronic device with an integrated connector housing. Another advantageous aspect of embodiments of the present invention includes a cover comprising an integrated connector housing, wherein the connector housing protects connector housing parts when the cover is removed from the electronic device. In addition, a cover comprising an integrated connector housing may advantageously protect internal components of the electrical device from ingress of water and/or other fluids when the cover is connected to the electrical device.

According to one embodiment, FIG. 1 illustrates a cover 100 for an electronic device. The cover comprises a connector housing 102. The cover 100 may include an exterior perimeter surface 104 and an interior perimeter surface 106. In addition, the cover 100 may include an interior primary surface 108 and an exterior primary surface 104, as shown in FIG. 3. The thickness of the cover 100 may be defined by the thickness between the interior surfaces and the exterior surfaces. Although illustrated as having a uniform thickness throughout, the cover 100 may have a varying thickness defined by a varying distance between the interior surfaces and the exterior surfaces. In some embodiments of the present invention, the connector housing 102 may be integrally molded with the cover 100 as a unitary structure. In another embodiment, the connector housing 102 may be permanently coupled with the cover 100, such as with an adhesive, a connector and/or the like. According to some embodiments, the cover 100 and the connector housing 102 may comprise a plastic material.

In some embodiments, the cover 100 may comprise a connector plate 122. The connector plate 122 may be coupled to the connector housing 102 so as to form an enclosed structure configured to receive a connector plug therein. Additionally and/or alternatively, the connector plate 122 may be coupled with the connector housing 102 so as to prevent and/or limit the ingress of water into the electronic device when the cover 100 is attached to the electronic device. As illustrated in FIG. 1, the connector plate 122 may include at least one connector plate contact surface 124. The connector plate contact surface 124 may be configured to be in electrical communication with components of the electronic device, such as a printed circuit board, printed wiring board, and/or the like. In addition, the connector plate contact surface 124 may be configured to be in electrical communication with at least one connector spring 120. Accordingly, the connector plate contact surface 124 may provide for the electrical communication between at least one connector spring 120 and components of the electrical device, such as a printed circuit board, printed wiring board, and/or the like. According to some embodiments, the connector plate 122 may be welded to the connector housing 102. In another embodiment, the connector plate 122 may be coupled to the connector housing with an adhesive and/or the like. According to some embodiments, the connector plate contact surface 124 may be formed as part of the connector plate 122 during a molding process. Additionally and/or alternatively, the connector plate 122 may be integrally formed with the housing 102 during a molding process and/or the like. In some embodiments, the connector plate contact surface may be an extended surface, part, and/or member of the connector spring, and may be configured to provide for the electrical communication between at least one component of the electrical device and a connector plug inserted into a cavity defined by the connector housing.

Additionally and/or alternatively, the cover may include a connector housing configured to engage with connector springs that are coupled to a printed circuit board, printed wiring board, and/or the like. Accordingly, when the cover is assembled with the electronic device, at least one connector spring coupled to a printed circuit board, printed wiring board, and/or the like may be configured to engage with the connector housing such that insertion of a connector plug into a cavity defined by the connector housing may cause a connection between the connector springs of the printed circuit board, printed wiring board, and/or the like to be created.

In another embodiment, a connector plate 222 may include at least one connector plate contact surface 224, as shown in FIG. 6B. Additionally and/or alternatively, the connector plate 222 may include a plurality of connector springs 220, as shown in FIG. 6A. As such, when the connector plate 222 is coupled with a connector housing 202 of a cover 200, the connector springs 220 may be configured to align with connector spring slots 218 of a connector housing 202.

FIG. 2 illustrates a cover 100 for an electronic device including a view of the connector housing 102. Specifically, the connector housing 102 may define a plug cavity 112, as shown in FIG. 3. The plug cavity 112 may be configured to receive a connector plug therein. For example, the plug cavity 112 may be configured to receive a headphone plug, microphone plug, and/or any other suitable audio-visual plug therein. In some embodiments, the plug cavity 112 may be substantially cylindrical in shape and may be configured to receive a tip-ring-sleeve (TRS) plug therein. In some embodiments, the plug cavity 112 may be configured to receive a connector plug therein with multiple ring portions and/or sleeve portions, such as a tip-ring-ring-sleeve plug. In another embodiment, the plug cavity 112 may be substantially rectangular and may be configured to receive a corresponding rectangularly-shaped plug therein.

FIG. 3 illustrates a zoomed view of a cover 100 and connector housing 102 according to one embodiment, while FIG. 4 illustrates a zoomed view of a cover 200 and connector housing 202 according to an alternative embodiment. The connector housing 202 may define a plug cavity 212, as shown in FIG. 5, which may be configured to receive the connector plug therein. Additionally and/or alternatively, the connector housing 202 may define a plurality of connector spring slots 218 configured to receive at least one connector spring 220 of the connector plate 222 therein. FIGS. 2 and 3 illustrate a plurality of connector spring slots 118 configured to receive at least one connector spring 120 therein. The connector springs 120 may be configured to contact a connector plug when the connector plug is inserted through the aperture and occupies the cavity 112. In another embodiment, the connector springs 220 of the connector plate 222 may be configured to contact a connector plug when the connector plug is inserted through the aperture and occupies the cavity 212. Accordingly, the cover 100 may be configured to protect the connector springs 120 when the cover is removed from an electronic device. For example, when the cover 100 is in an assembled state with an electronic device, the cover 100 defines an enclosed chamber housing various components of the electronic device. In addition, the cover 100 is configured to deny access to the connector housing 102 when the cover is in an assembled state with the electronic device.

When the cover is removed from the electronic device, the interior primary surface 108 of the cover is exposed to a user, but the connector housing 102 may be further configured to protect the connector springs 120 by preventing the exposure of the connector springs 120. The plurality of connector springs 120 may be protected when the cover 100 is removed from the electronic device. In some embodiments, the protection may include protection from inadvertently accessing the connector springs, inadvertent removal of the connector springs from the connector housing, physical damage and/or destruction of the connector springs, and/or the like. In some embodiments, the connector housing 102 may fully enclose the connector springs 120. Alternatively, the connector housing 102 may be configured to shield the connector springs 120 by defining the plurality of connector spring slots 118 therein such that the connector springs 120 do not protrude from the connector housing 102. For example, the depth of the connector spring slots 118 may be defined by the connector housing 102 to be greater than the height of the connector spring. As such, although the connector springs 120 may be visible when the cover 100 is removed from the electronic device, the connector springs 120 do not protrude from the connector housing 102 and are thus protected when the cover 100 is removed from the electronic device.

In some embodiments, the perimeter surface 104 of the cover 100 may define an aperture 114 substantially aligned with the cavity 112, the aperture 114 providing access to the cavity 112. In some embodiments, the aperture 114 may be substantially circular. For example, when the exterior perimeter surface 104 of the cover 100 is perpendicular to a central axis extending through the cavity 112 and the interior aperture surface 116 is cylindrical in shape, the aperture 114 may be substantially circular. In another embodiment of the present invention, the aperture 114 may be substantially oval. Specifically, when the exterior perimeter surface 104 is not perpendicular to the cavity 112 and the interior aperture surface 116 is cylindrical in shape, the aperture 114 may be substantially oval. In other words, when the interior aperture surface 116, which is defined by the cover 100, is cylindrical in shape and the exterior perimeter surface intersects the central axis extending through the aperture at a non-90 degree angle, the aperture 114 will be substantially oval when viewed perpendicularly to the exterior perimeter surface 104, while the interior aperture surface 116 remains cylindrical in shape. Further, the central axis of a cylindrically-shaped interior aperture surface 116 may be aligned and/or co-linear with the central axis of the cavity 112. Accordingly, the aperture 114 provides access to the cavity 112 such that a connector plug may be inserted therein irrespective of the shape of the cover 100, the exterior perimeter surface 104, and/or the interior perimeter surface 106. As such, one advantageous aspect of embodiments of the present invention include that the interior perimeter surface 106 and/or the exterior perimeter surface 104 of the cover 100 does not need to be perpendicular to the central axis extending through the aperture 114 and/or the cavity 112 as the connector housing 102 and the cover 100 are integrally connected as a unitary structure. As such, no gaps, seams, openings and/or the like are created between the connector housing 102 and the cover 100.

According to some embodiments of the present invention, the connector housing 102 may further be configured to provide a water-resistant and/or waterproof connector housing 102 integrally molded with the cover 100. For example, the integral molding of the connector housing 102 with the cover 100 minimizes the number of seams, joints, and/or openings for fluids to travel through. Likewise, the minimization of the number of seams, joints, and/or openings further provides for a dust-resistant and/or dustproof connector housing 102. In some embodiments, the connector housing 102 may be welded, adhered, and/or coupled to the cover 100 so as to provide a permanent connection. For example, the connector housing 102 may be molded as a separate part from the cover 100. In addition, the cover 100 may include an integrally molded receptacle configured to receive the connector housing 102 therein. A resin may then be applied to adhere the connector housing 102 with the cover 100, thus providing a water-resistant, waterproof, dust-resistant, and/or dustproof cover 100 comprising a connector housing 102.

Another advantageous aspect of some embodiments of the present invention includes increased freedom for designing the interior dimensions of the cover 100. For example, unlike typical covers which may include a cover and a connector plate comprising connector plug springs, embodiments of the present invention provide greater freedom when designing how various electronic parts are assembled and/or connected in the interior chamber provided by the cover when the cover and the electronic device are in the assembled state. Specifically, typical covers require pre-determined attachment points for connecting a connector plate to the cover. Further, the pre-determined attachment points define an internal volume that occupies a space greater than the connector plate. Accordingly, the space occupied by a typical connector plate and the corresponding attachment points is greater than the space occupied by certain embodiments of the present invention.

Many modifications and other embodiments of the invention set forth herein will come to mind to one skilled in the art to which these inventions pertain having the benefit of the teachings presented in the foregoing description and associated drawings. Therefore, it is to be understood that the inventions are not to be limited to the specific embodiments disclosed. Although specific terms are employed herein, they are used in a generic and descriptive sense only and not for purposes of limitation.

That which is claimed:

1. A cover for an electronic device comprising:

a connector housing integrally molded with the cover, the connector housing defining a cavity configured to receive a connector plug therein;

a plurality of connector springs configured to contact the connector plug when the connector plug occupies the cavity; and a connector plate comprising at least one connector plate contact surface, wherein the connector plate contact surface is configured to communicate with at least one connector spring, and wherein the plurality of springs are protected when the cover is removed from the electronic device.

2. The cover of claim 1, wherein the connector housing includes a plurality of slots configured to receive the plurality of connector springs therein.

3. The cover of claim 1, wherein the cavity defined by the connector housing is substantially cylindrical.

4. The cover of claim 1, wherein the connector housing further comprises a plastic material.

5. The cover of claim 1, wherein the plurality of springs are not exposed when the cover is removed from the electronic device.

6. The cover of claim 1, wherein the plurality of springs do not protrude from the connector housing when the cover is removed from the electronic device.

7. The cover of claim 1 further comprising a connector plug aperture defined by a perimeter surface of the cover, wherein a central axis of the connector plug aperture is substantially aligned with the central axis of the cavity.

8. The cover of claim 7, wherein the connector plug aperture is substantially circular in shape.

9. The cover of claim 7, wherein the connector plug aperture is oval in shape.

10. The cover of claim 7, wherein the perimeter surface of the cover defining the connector plug aperture is not perpendicular to the central axis of the cavity.

11. A cover for an electronic device comprising:

a connector housing coupled with the cover, the connector housing defining a cavity configured to receive a connector plug therein;

a plurality of connector springs configured to contact the connector plug when the connector plug occupies the cavity;

a connector plate comprising at least one connector plate contact surface, wherein the connector plate contact surface is configured to communicate with at least one connector spring, wherein each of the connector springs are biased into engagement with a respective connector plate contact surface, and wherein the plurality of springs are protected when the cover is removed from the electronic device.

12. The cover of claim 11, wherein the connector housing include a plurality of slots configured to receive the plurality of connector springs therein.

13. The cover of claim 11, wherein the cavity defined by the connector housing is substantially cylindrical.

14. The cover of claim 11, wherein the connector housing further comprises a plastic material.

15. The cover of claim 11, wherein the plurality of springs are not exposed when the cover is removed from the electronic device.

16. The cover of claim 11, wherein the plurality of springs are coupled with the connector plate.

17. The cover of claim 11, wherein the connector housing is permanently coupled to the cover.

18. The cover of claim 17, wherein the connector housing is welded to the cover.

19. The cover of claim 11 further comprising a connector plug aperture defined by a perimeter surface of the cover, wherein a central axis of the connector plug aperture is substantially aligned with the central axis of the cavity.

20. The cover of claim 19, wherein the connector plug aperture is substantially circular in shape.

21. The cover of claim 19, wherein the connector plug is substantially oval in shape.

22. The cover of claim 19, wherein the perimeter surface of the cover defining the connector plug aperture is not perpendicular to the central axis of the cavity.

* * * * *